US006317107B1

(12) United States Patent
Ninoyu et al.

(10) Patent No.: US 6,317,107 B1
(45) Date of Patent: Nov. 13, 2001

(54) EL DISPLAY DEVICE WITH DIELECTRIC BREAKDOWN INHIBITING FEATURE

(75) Inventors: Toshinori Ninoyu, Nagoya; Kiyoshi Saeki, Okazaki; Hiroyuki Kishita; Tomoya Uchida, both of Kariya; Hideki Saito, Chiryu; Masahiko Osada, Hekinan, all of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/276,498

(22) Filed: Mar. 25, 1999

(30) Foreign Application Priority Data

Mar. 27, 1998 (JP) ..... 10-082010

(51) Int. Cl.[7] ..... G09G 3/30
(52) U.S. Cl. ..... 345/76; 345/77
(58) Field of Search ..... 345/76, 79, 209; 315/169.2, 169.3

(56) References Cited

U.S. PATENT DOCUMENTS 4,864,182 * 9/1989 Fujioka et al. ..... 315/169.3
4,962,374 * 10/1990 Fujioka et al. ..... 345/79
5,517,207 5/1996 Kawada et al. .
5,847,516 * 12/1998 Kishita et al. ..... 315/169.3
6,091,382 * 7/2000 Shioya et al. ..... 345/76
6,091,383 * 7/2000 Borzea et al. ..... 345/76

FOREIGN PATENT DOCUMENTS 1-200287 8/1989 (JP) .
9-54566 2/1997 (JP) .

* cited by examiner

*Primary Examiner*—Steven Saras
*Assistant Examiner*—Uchendu O. Anyaso
(74) *Attorney, Agent, or Firm*—Pillsbury Winthrop LLP

(57) ABSTRACT

An EL display in which expansion of dielectric breakdown occurring at any one of EL elements is inhibited. Scan electrodes are arranged to receive an offset voltage Vm at those instances other than during application of a scanning voltage thereto in a positive field, while a predetermined voltage is applied to data electrodes to prevent voltage from being applied to EL elements immediately after application of the scan voltage. Accordingly, even where dielectric breakdown occurs at any one of the EL elements due to application of a light emission driving pulse voltage, it is possible to inhibit current flow between the scan electrodes and the data electrodes to thereby inhibit further subsequent dielectric breakdown.

17 Claims, 6 Drawing Sheets

EL DISPLAY DEVICE WITH DIELECTRIC BREAKDOWN INHIBITING FEATURE

CROSS-REFERENCE TO RELATED APPLICATIONS

The present application is related to, and claims priority from, pending Japanese Patent Application No. 10-82010, the contents of which are hereby incorporated by reference.

BACKGROUND OF THE INVENTION

1. Technical Field of the Invention

The present invention relates generally to electroluminescent (EL) display devices, and more particularly to an EL display device in which a predetermined voltage is periodically applied to the EL elements to make the applied potential difference substantially zero, thereby inhibiting dielectric breakdown.

2. Description of the Related Art

A conventional EL display device, such as that disclosed in Published Unexamined Japanese Application JPA-9-54566, includes an EL display panel having scan and data electrodes which are laid out in rows and columns. EL elements are formed at intersecting regions of the scan and data electrodes, thereby creating a matrix display. In this display, a scanning voltage is progressively applied from a scan-side driver IC to the scan electrodes, while a data voltage is applied to the data electrodes from a data-side driver IC. Luminescence/non-luminescence driving pulse voltages differing in polarity once per each of positive and negative fields are applied to the EL elements, which consequently emit or do not emit light in response thereto. Also, the display disclosed in the above-identified Japanese application is designed so that an offset voltage having a positive polarity is applied to the positive field scan electrodes to reduce the breakdown voltage of the scan-side driver IC.

In FIG. 7, some exemplary voltage waveforms characteristic of the above-discussed display are shown, including voltage waveforms of three successive scan electrodes 1, 2, 3 and a voltage waveform of one data electrode, as well as voltage waveforms between the scan electrode 1 and its associated data electrode.

In the positive field, a voltage shown by the solid line is applied to the scan electrode during application of a scan voltage, as well as in preceding and subsequent periods. Otherwise, the voltage is in a floating (high impedance) state shown by the dotted line.

In this case, when the data electrode outputs a light emission pulse (0V), the scan electrode is set in the high impedance state and the offset voltage Vm is applied to the EL elements. Subsequently, the offset voltage Vm applied to the EL elements becomes a DC voltage while the scan electrode is in the high impedance state.

In the negative field, when the data electrode outputs a light emission pulse (Vm), the scan electrode is set in the high impedance state, and the data voltage Vm is applied to the EL elements. Thus, a data voltage −Vm applied to the EL elements becomes a DC voltage when the scan electrode is in the high impedance state.

The EL elements of the above display are arranged so that each is structured from a light emission or "luminous" layer sandwiched between a pair of dielectric films.

However, the dielectric films can typically contain local defects. More specifically, unwanted particles are often deposited on or in the dielectric layers during formation thereof. As a result, the actual film-forming value of the layers is less than a target value. Although the particles are removed by brushing the layers during the formation process, the particles inherently leave behind tracks, or small indentations, in the respective surfaces of the layers.

Subsequently, when a pulse voltage is applied to the films to produce light emission, the resulting electric field is concentrated in the tracks, thereby increasing the potential for dielectric breakdown at these points.

As shown in FIG. 7, if a specified DC voltage is continuously applied at times other than when the light emission drive pulse voltage is applied, electrical discharge continues between the scan electrode and data electrode, as the pulse voltage forces a current to be continuously supplied thereto. This continued electrical discharge thereby increases the risk of further dielectric breakdown.

SUMMARY OF THE INVENTION

The present invention has been made in view of the aforementioned problem, and its object is to eliminate increased dielectric breakdown in EL elements.

To obtain the foregoing object, a significant feature of the present invention is the periodic application of a specific voltage to data electrodes which prevent a voltage from being applied to EL elements.

Accordingly, even when dielectric breakdown occurs at either one of the EL elements, it becomes possible to eliminate the current flowing between the scan electrode and data electrode, and thus prevent an increase in dielectric breakdown.

DETAILED DESCRIPTION OF THE PREFERRED EMBODIMENTS

Figure 1:
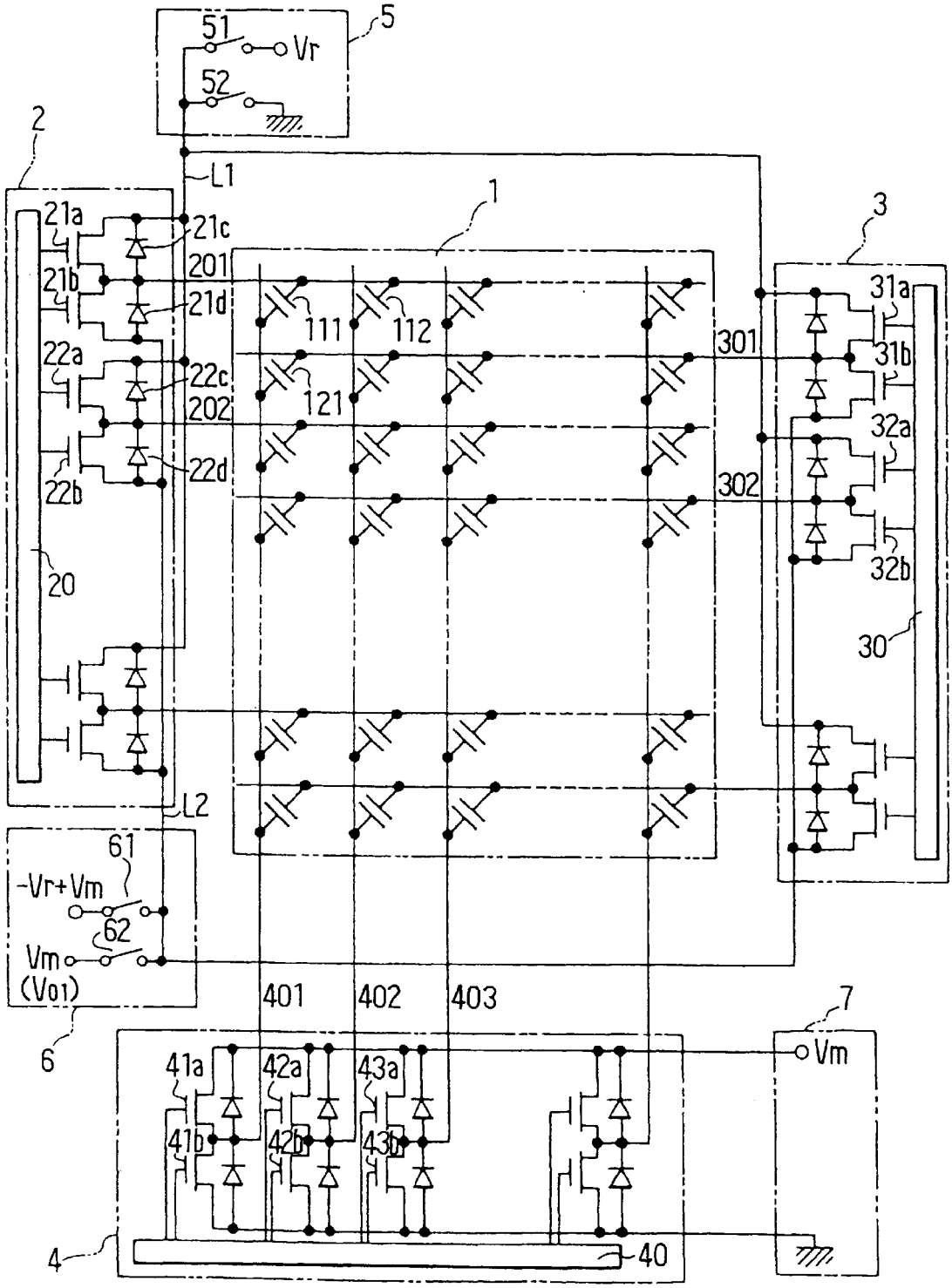
FIG. 1 is a diagram showing a configuration of an EL display device in accordance with one preferred embodiment of the present invention.

FIG. 1 shows an overall configuration of an EL display device in accordance with one preferred embodiment of the present invention.

An EL display panel 1 includes a light emission layer having one side on which scan electrodes are formed and another side on which data electrodes are formed. As shown, an odd number of scan electrodes 201, 202, . . . and an even number of scan electrodes 301, 302, . . . are formed in the row direction whereas data electrodes 401, 402, 403, . . . are formed in the column direction. In respective intersection regions between the scan electrodes 201, 301, 202, 302, . . . and data electrodes 401, 402, 403, . . . , EL elements 111, 112, . . . , 121, . . . are formed as picture elements or "pixels."

To drive the EL display panel 1, scan-side driver ICs 2, 3 and data-side driver IC 4 are provided. The scan-side driver IC 2 is a drive circuit of the push-pull type which has P-channel FETs 21*a*, 22*a*, . . . and N-channel FETs 21*b*, 22*b*, . . . connected to the odd number scan electrodes 201, 202, . . . , and applies a scan voltage (scan pulse) to the odd number scan electrodes 201, 202, . . . . in response to receipt of an output from a control circuit 20. Parasitic diodes 21*c*, 21*d*, 22*c*, 22*d*, . . . are formed respectively at the FETs 21*a*, 21*b*, 22*a*, 22*b*, . . . for enabling scan electrodes to be set at a desired reference voltage.

The scan-side driver IC 3 is similar in configuration: it has a control circuit 30, P-channel FETs 31*a*, 32*a*, . . . and N-channel FETs 31*b*, 32*b*, . . . for supplying a scan voltage to even number scan electrodes 301, 302, . . . .

The data-side driver IC 4 has a control circuit 40, P-channel FETs 41*a*, 42*a*, . . . and N-channel FETs 41*b*, 42*b*, . . . for supplying a data voltage (select pulse) to the data electrodes 401, 402, 403, . . . .

The scan-side driver ICs 2 , 3 are provided with scan voltage supply circuits 5, 6 for supplying scan voltages. The scan voltage supply circuit 5 has switching elements 51, 52 and is operable to supply either a write voltage Vr or ground voltage (0V) to a P-channel FET source-side common line L1 in the scan-side driver ICs 2, 3 in accordance with the ON/OFF state thereof. The scan voltage supply circuit 6 has switching elements 61, 62 and is responsive to the ON/OFF state thereof for supplying either a DC voltage −Vr+Vm or offset voltage Vm to an N-channel FET source-side common line L2 at the scan-side driver ICs 2, 3.

The data-side driver IC 4 is provided with a data voltage supply circuit 7 for supplying a modulation voltage Vm to a P-channel FET source-side common line of the data-side driver IC 4 while supplying the ground voltage to an N-channel FET source-side common line.

Figure 4:
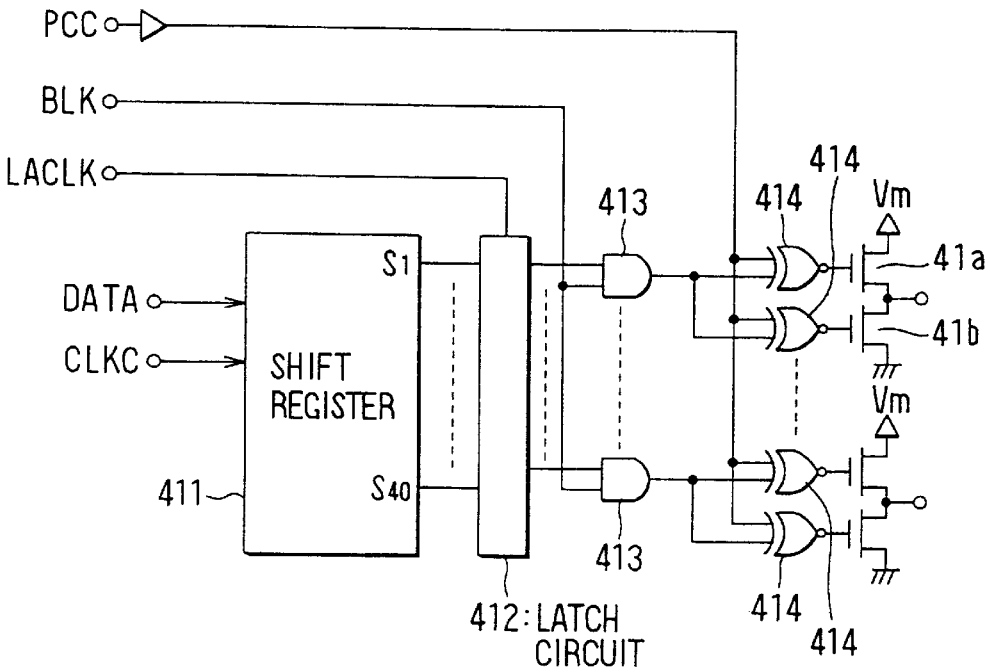
FIG. 4 is a diagram showing a practical configuration of a data-side driver IC in FIG. 1.

It should be noted that the above-mentioned scan voltage supply circuits 5, 6 and data voltage supply circuit 7 used herein are the same as those shown in FIG. 4 of JP-A-9-54566, and are designed to employ two power supply units to output the above various voltages.

In the above-described configuration, it is necessary to apply an AC pulse voltage between the scan electrodes and data electrodes to drive the EL elements for light-emitting purposes. To this end, a pulse voltage which inverts between the positive and negative polarities once per field is generated with respect to each scan line to drive the EL elements.

In the positive field a voltage Vr is sequentially supplied as the scan voltage to the scan electrodes 201, 301, 202, 302, . . . . For the data electrodes 401, 402, 403, . . . , the voltage of an EL element data electrode required to emit light is set at the ground voltage. Also, the voltage of an EL element data electrode not required to emit light is set at the modulation voltage Vm. Subsequently, a voltage Vr that is potentially greater than or equal to the threshold voltage is applied to the EL element which is to emit light, thereby causing the EL element to emit light. On the other hand, a voltage +Vr−Vm that is lower in potential than the threshold voltage is applied to the EL element not required to emit light so that the EL element does not emit light.

In the negative field a voltage of −Vr+vm is progressively applied as the scan voltage to the scan electrodes 201, 301, 202, 302 , . . . . For the data electrodes 401, 402, 403, . . . , the voltage of an EL element data electrode required to emit light is set at the modulation voltage Vm, while the voltage of an EL element data electrode not required to emit light is set at the ground voltage. At this time a voltage −Vr that is potentially greater than or equal to the threshold voltage is applied to the EL element required to emit light thereby causing the EL element to emit light, whereas a voltage of −Vr+Vm is applied to the EL element not required to emit light so that the EL element does not emit light.

The above-stated one cycle positive and negative field driving pattern is repeated, causing the EL display panel 1 to perform a desired display operation. It should be noted that the use of the offset voltage Vm permits application of a voltage of absolute value Vr−Vm in both the positive field and the negative field in the scan-side driver ICs 2, 3, thereby enabling the breakdown voltage of scan-side driver ICs 2, 3 to be decreased as compared to those not utilizing such offset voltage Vm.

Figure 2:
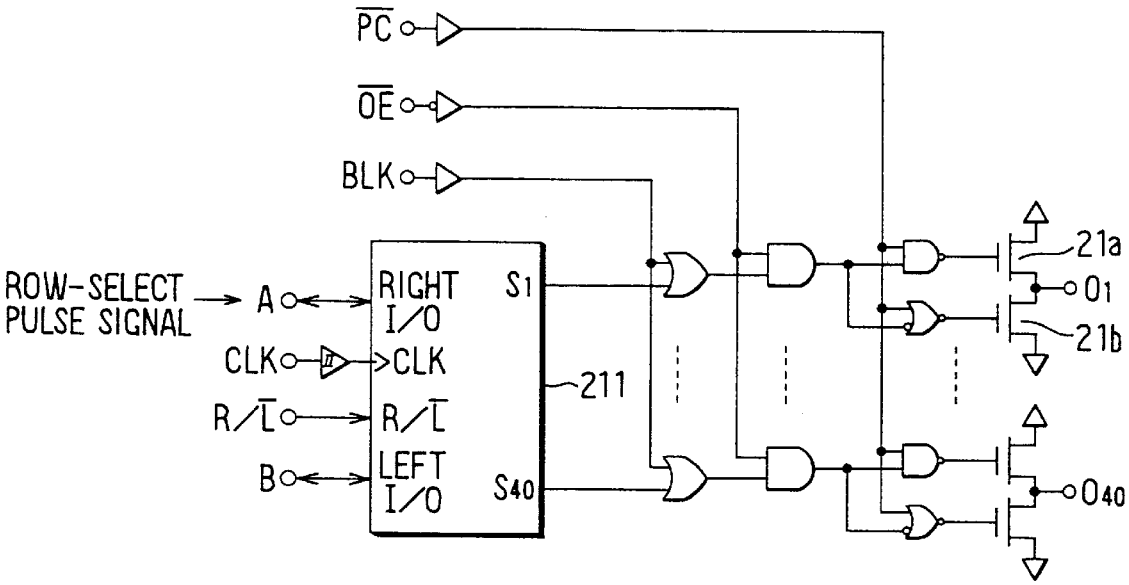
FIG. 2 is a diagram showing one practical configuration of a scan-side driver IC in FIG. 1.

As the scan-side driver ICs 2, 3 discussed above, a commercially available scan-side driver IC under the name of "μ PD16302" may be used as shown in FIG. 2. This scan-side driver IC is configured from a shift register 211, logic circuits shown in the drawing, an output circuit (P-channel FETs 21*a*, 31*a*, 22*a*, 32*a*, . . . and N-channel FETs 21*b*, 31*b*, 22*b*, 32*b*, . . . ) and the like.

The shift register 211 is operable, when its R/L bar (representing the negative logic number shown in FIG. 2) terminal is at the high level (H level), to progressively shift by a CLK signal a row-select pulse signal input at a data input terminal "A" for sequential output from a terminal $S_1$ to a terminal $S_{40}$.

In this case a blanking (BLK) signal and an OE bar signal, which becomes the output enable signal, are forced to constantly remain at the low level (L level), to thereby ensure that a PC bar signal is input as a signal for selecting P-channel FETs or N-channel FETs.

Figure 3:
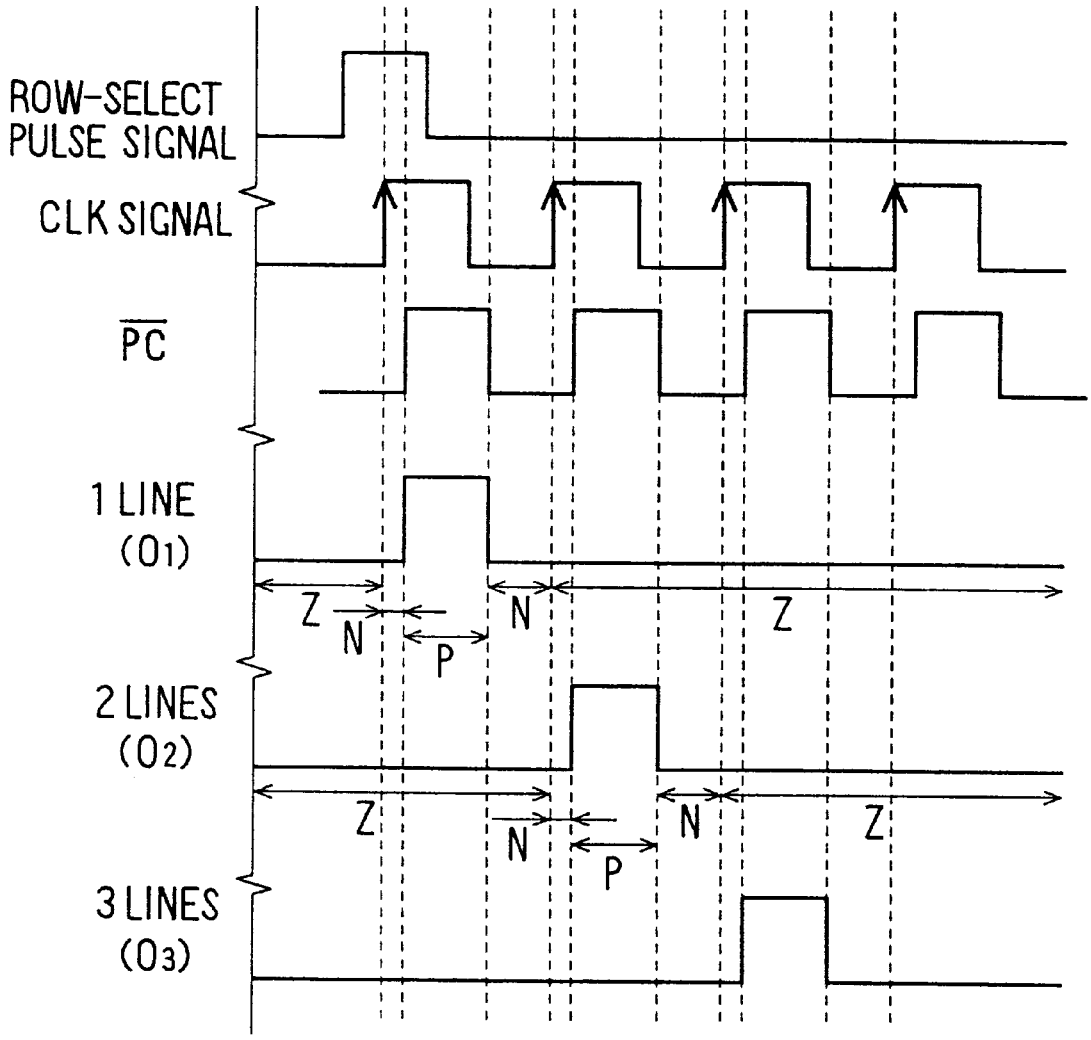
FIG. 3 is a timing diagram illustrating operation in the positive field of the scan-side driver IC shown in FIG. 2.

In this arrangement, when a row select pulse signal is input to the shift register 211, the row select pulse signal is progressively shifted for output, as shown in the positive field timing diagram of FIG. 3. During a time period in which the row select pulse signal is being output, the turn-on periods of P-channel FETs and N-channel FETs are switched in accordance with the changeover of the PC bar signal between the H and L levels, thereby causing a voltage potentially responsive thereto to be output from an output terminal O. It should be noted that the letter "Z" in FIG. 3 is representative of the time period of high impedance, "P" indicates the period in which the P-channel FETs are turned on to perform charging, and "N" denotes the period in which the N-channel FETs are turned on to perform discharging. Also, it should be noted that in the negative field the H and L levels of the PC bar signal are opposite to those in the case of the positive field.

Figure 6:
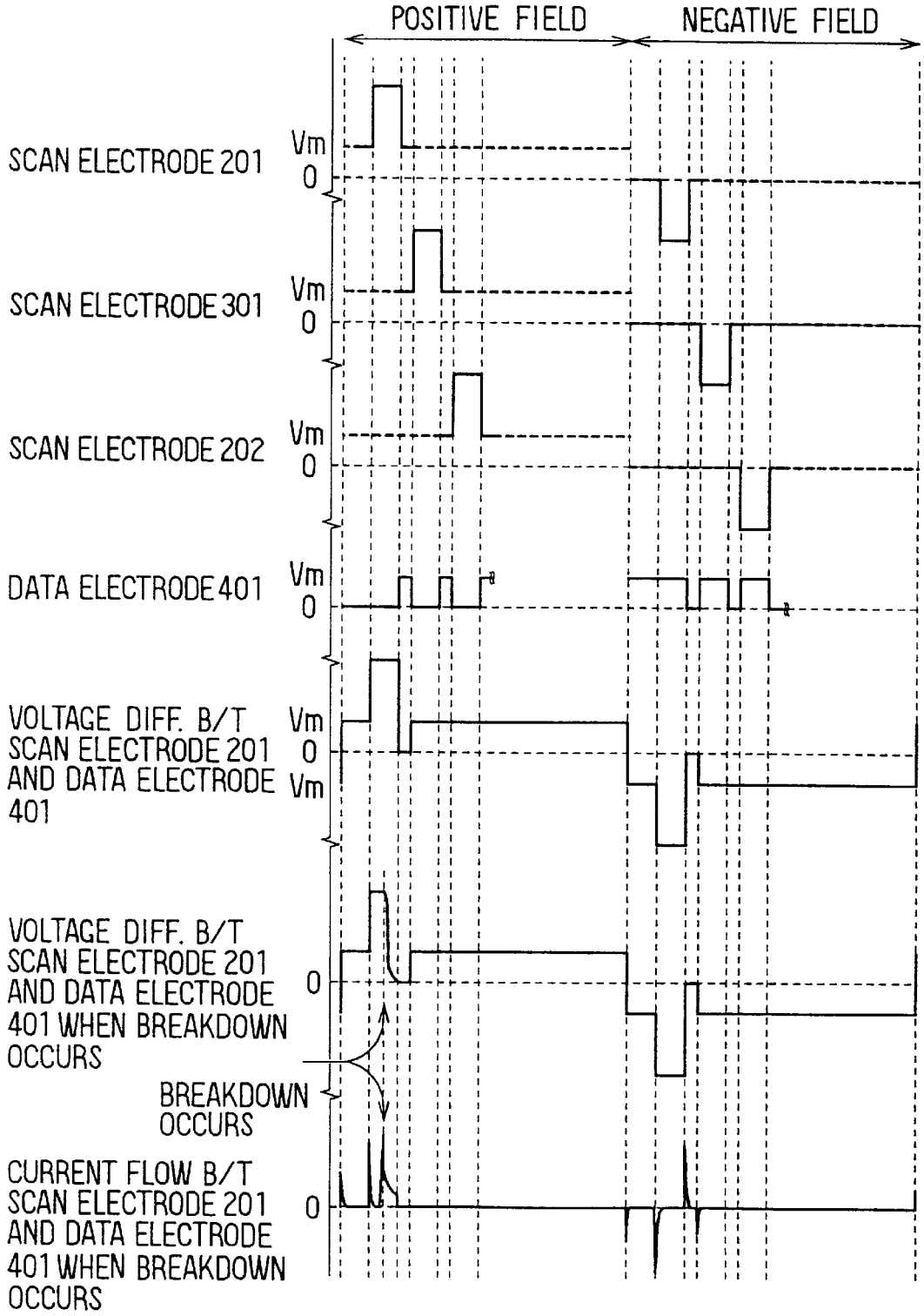
FIG. 6 is a timing diagram illustrating operation of the EL display device shown in FIG. 1.
Figure 7:
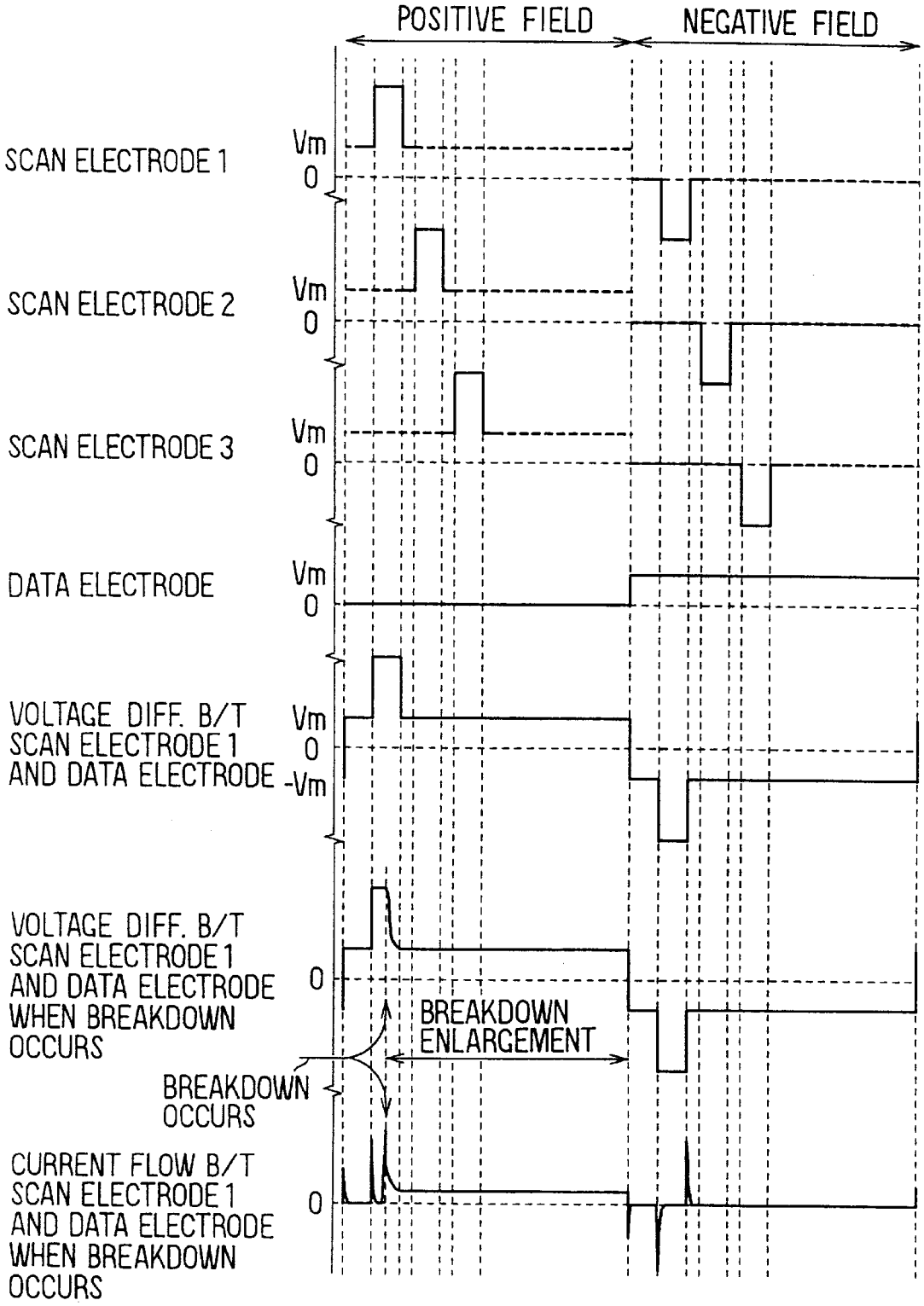
FIG. 7 PRIOR ART
FIG. 7 is a timing diagram illustrating operation of one prior art EL display device.

By turning on and off the P-channel FETs 21*a*, 31*a*, 22*a*, 32*a*, . . . and N-channel FETs 21*b*, 31*b*, 22*b*, 32*b*, . . . in the sequence stated above, the scan voltage is sequentially output to the scan electrodes 201, 301, 202, . . . as shown in FIG. 6. Note that dotted lines in the drawing are used to designate the state in which the high impedance is established.

Figure 5:
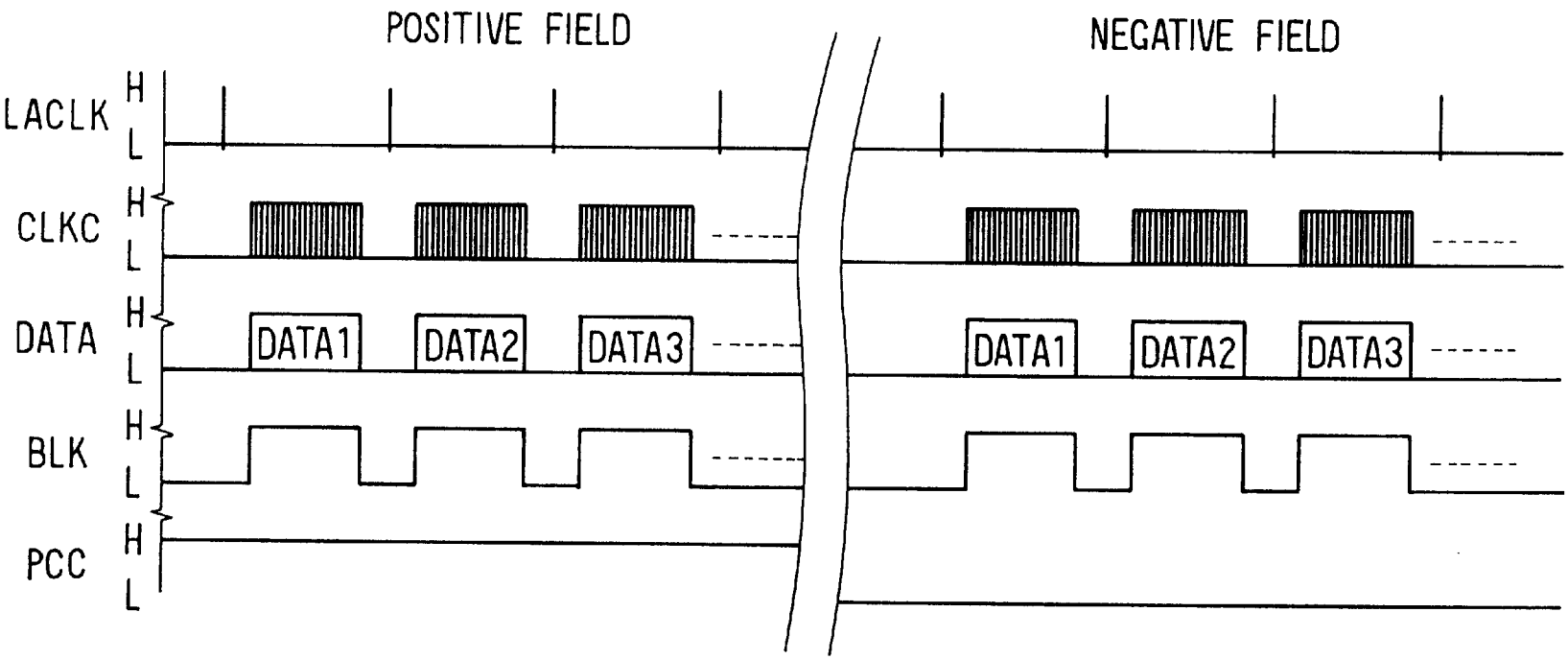
FIG. 5 is a timing diagram for illustrating operation of the data-side driver IC shown in FIG. 4.

An explanation will next be given of the data-side driver IC 4. FIG. 4 shows a practical circuit configuration thereof, and FIG. 5 shows a timing diagram of respective signals shown in FIG. 4.

The data-side driver IC 4 includes a shift register 411, a latch circuit 412, an AND circuit 413, an EX-NOR circuit 414, an output circuit (P-channel FETs 41*a*, 42*a*, . . . and N-channel FETs 41*b*, 42*b*, . . . ) and the like.

The shift register 411 is arranged so that DATA indicative of display data per row is input thereto. This input DATA is sequentially shifted by a CLKC signal and is then latched at the latch circuit 412 at a timing of generation of a LACLK signal. This latched DATA is output from the AND circuit 413 within a time period in which the blanking (BLK) signal is kept at the H level. This output DATA is then subject to logical processing with a PCC signal (a signal which is at the H level in the positive field and at the L level in the negative field) at the EX-NOR circuit 414 to thereby turn on and off the P-channel FETs and N-channel FETs in the output circuit.

More specifically, in the positive field, since the PCC signal is at the H level, if the DATA as latched at the latch circuit 412 stays at the H level within a time period in which the BLK signal is at the H level, then the P-channel FETs in the output circuit are turned off, and the N-channel FETs are turned on, thereby causing the ground voltage to be output. Alternatively, if the DATA being latched at the latch circuit 412 is at the L level, then the P-channel FETs in the output circuit turn on, whereas the N-channel FETs turn off, thereby causing the voltage Vm to be output. As a result, when the DATA is at the H level the EL elements are in a light emissive state, while when DATA is at the L level, the EL elements are in a non-emissive state.

On the other hand, in the negative field, since the PCC signal is at the L level, if the DATA as latched at the latch circuit 412 stays at the H level when the BLK signal is at the H level, then the P-channel FETs in the output circuit turn on and the N-channel FETs turn off to thereby output the voltage Vm. Alternatively, if the DATA being latched at the latch circuit 412 is at the L level then the P-channel FETs in the output circuit turn off whereas the N-channel FETs turn on, causing the ground voltage to be output. Due to this, when the DATA is at the H level the EL elements are in the light emissive state, while when DATA is at the L level the EL elements are in the non-emissive state.

A control circuit (not shown) is used to periodically set the BLK signal at the L level as shown in FIG. 5. With such an arrangement, in the positive field, when the BLK signal is at the L level the P-channel FETs in the output circuit turn on, whereas the N-channel FETs therein turn off, thereby causing the voltage Vm to be set.

At this time, with the L-level holding period of the BLK signal being a time period in which the N-channel FETs in the scan-side driver IC turn on to perform discharging (the period N after application of the scan voltage shown in FIG. 3), the offset voltage Vm is applied to the scan electrodes while the voltage Vm is applied to the data electrodes. This in turn permits setup of a specific time period immediately after the scan voltage is applied to the scan electrodes, during which no voltage is applied to the EL elements.

In the negative field, when the BLK signal is at the L level the P-channel FETs in the output circuit turn off, whereas the N-channel FETs turn on, causing the ground voltage to be output. Accordingly, even in the negative field, a specific time period is established immediately after the scan voltage is applied, during which no voltage is applied to the EL elements.

The above-mentioned time period in which no voltage is applied to the EL elements immediately after the scan voltage is applied inhibits dielectric breakdown.

Therefore, the breakdown that occurs prior to the voltage non-application period is a self-recovery type dielectric breakdown, as even when one of the EL elements breaks down dielectrically due to light emission pulses, the resultant dielectric breakdown is no longer prolonged.

For example, even when a light emission pulse voltage is applied between the scan electrode 201 and data electrode 401 and dielectric breakdown occurs at an EL element, voltage application is inhibited between the scan electrode 201 and data electrode 401 as shown in FIG. 6 just after occurrence of such dielectric breakdown to inhibit current flow between the scan electrode 201 and the data electrode 401. As a result, no dielectric breakdown takes place even upon re-application of a light emission pulse voltage.

It should be noted that the above-mentioned time period in which no voltage is applied to the EL elements is preferably designed to be less than or equal to 20 $\mu$s both in the positive field and in the negative field. Also, although in the foregoing illustrative embodiment the EL element is provided with a voltage application inhibition period immediately after the scan voltage is applied, this period may alternatively be provided at other predetermined intervals as long as EL element dielectric breakdown is eliminated as described above.

It should further be noted that the scan voltage and data voltage are modifiable so that the polarity thereof is opposite to that in the above-described embodiment while an offset voltage of the negative polarity in the negative field is provided.

While the above description constitutes the preferred embodiment of the present invention, it should be appreciated that the invention may be modified without departing from the proper scope or fair meaning of the accompanying claims. Various other advantages of the present invention will become apparent to those skilled in the art after studying the foregoing text and drawings taken in conjunction with the following claims.

What is claimed is:

1. An EL display device, comprising:

an EL display panel including a row-and-column matrix array of scan electrodes and data electrodes with EL elements being formed at intersections of said scan electrodes and said data electrodes;

scan electrode driver circuits for applying to said scan electrodes a scan voltage changeable in polarity once per each positive and negative field; and a data electrode driver circuit for applying to said data electrodes a data voltage that causes said EL elements to operate in one of a light emissive and a light non-emissive state;

said scan electrodes being arranged so that an off-set voltage is applied thereto during times other than when said scan voltage is applied; and said data electrodes being arranged so that a predetermined voltage is periodically applied thereto to create a potential difference applied to the EL display panel of substantially zero, wherein no voltage is applied for a time period between applications of said scan voltage to said scan electrodes.

2. The EL display device of claim 1, wherein said predetermined voltage is applied to said data electrodes in a respective one of said positive and negative fields.

3. The EL display device of claim 2, wherein said predetermined voltage is applied to said data electrodes immediately after said scan voltage is applied to said scan electrodes.

4. The EL display device of claim 3, wherein said predetermined voltage is applied for a time period less than or equal to 20 $\mu$ seconds.

5. The EL display device of claim 1, wherein said predetermined voltage equals said offset voltage.

6. An EL display device, comprising:

an EL display including a plurality of EL elements;

a plurality of EL element driver circuits for driving the plurality of EL elements to selectively cause certain of the plurality of EL elements to emit light according to a display operation; and a control device for controlling the plurality of EL element driver circuits and for causing a predetermined voltage to be periodically applied across the plurality of EL elements to make a potential difference thereacross substantially zero, wherein no voltage is applied for a time period between applications of said predetermined voltage to said plurality of EL elements.

7. The EL display device of claim 6, wherein the plurality of EL elements comprises pixels formed from a row-and-column matrix array of scan electrodes and data electrodes.

8. The EL display device of claim 7, wherein the plurality of EL element driver circuits comprises a plurality of scan electrode driver circuits for applying a scan voltage to the scan electrodes; and a data electrode driver circuit for selectively applying to the data electrodes a data voltage that causes the EL elements to operate in one of a light emissive and a light non-emissive state.

9. The EL display device of claim 8, wherein the predetermined voltage is applied to the data electrodes immediately after the scan voltage is applied to the scan electrodes.

10. The EL display device of claim 8, wherein the control device comprises at least one scan-side control circuit for controlling the scan voltage of the scan electrode driver circuits and a data-side control circuit for controlling the data voltage of the data electrode driver circuit.

11. The EL display device of claim 8, wherein the scan electrodes are arranged so that an off-set voltage is applied thereto during times other than when the scan voltage is applied; and the data electrodes are arranged so that the predetermined voltage is periodically applied thereto to make the potential difference applied across the plurality of EL display elements substantially zero.

12. The EL display device of claim 11, wherein the predetermined voltage equals the offset voltage.

13. The EL display device of claim 6, wherein the predetermined voltage is applied for a time period less than or equal to 20 $\mu$ seconds.

14. A method of controlling operation of an EL display device including an array of scan electrodes and data electrodes in which a plurality of EL elements are formed at intersections of the scan electrodes and the data electrodes, comprising:

applying a scan voltage to the scan electrodes;

applying a data voltage to the data electrodes to cause certain of the data electrodes to emit light according to a predetermined display operation;

applying an off-set voltage to the scan electrodes at times other than during application of a scan voltage; and periodically applying a current inhibiting voltage to the data electrodes to inhibit current flow across the plurality of EL elements, wherein no voltage is applied to said EL elements for a time period between applications of said scan voltage to said scan electrodes.

15. The method of claim 14, wherein periodically applying a current inhibiting voltage to the data electrodes comprises applying a current inhibiting voltage in both positive and negative fields during one display cycle of the EL display device.

16. The method of claim 14, wherein periodically applying a current inhibiting voltage to the data electrodes occurs immediately after applying a scan voltage to the scan electrodes.

17. The method of claim 14, wherein periodically applying a current inhibiting voltage is performed for a period less than or equal to 20 $\mu$ seconds.

* * * * *